US008256137B2

(12) United States Patent
Noviello et al.

(10) Patent No.: US 8,256,137 B2
(45) Date of Patent: Sep. 4, 2012

(54) DETERMINING CLOG STEAM GENERATOR TANK FILTER LAUNDRY DRIER, AND APPARATUS

(75) Inventors: Flavio Noviello, Aviano (IT); Gennaro Napolitano, Pordenone (IT); Mirko Cenedese, Conegliano (IT); Roberto Ragogna, Malnisio (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 458 days.

(21) Appl. No.: 12/668,444

(22) PCT Filed: Jul. 11, 2008

(86) PCT No.: PCT/EP2008/005696

§ 371 (c)(1),
(2), (4) Date: Jan. 11, 2010

(87) PCT Pub. No.: WO2009/010242

PCT Pub. Date: Jan. 22, 2009

(65) Prior Publication Data

US 2010/0180465 A1 Jul. 22, 2010

(30) Foreign Application Priority Data

Jul. 13, 2007 (EP) ..... 07122489

(51) Int. Cl.
*F26B 3/00* (2006.01)

(52) U.S. Cl. ..... 34/413; 34/497; 34/595; 34/601; 34/606; 8/158; 68/18 R; 68/18 C

(58) Field of Classification Search ..... 34/381, 34/413, 497, 524, 595, 601, 606, 90; 68/18 R, 68/18 C; 8/158, 159
See application file for complete search history.

(56) References Cited

U.S. PATENT DOCUMENTS

| | | | | |
|---|---|---|---|---|
| 2,316,669 | A * | 4/1943 | Busi | 68/20 |
| 3,134,652 | A * | 5/1964 | D'Angelo et al. | 34/77 |
| 3,402,576 | A * | 9/1968 | Krupsky | 68/4 |
| 4,262,430 | A * | 4/1981 | Janson et al. | 34/524 |
| 6,314,601 | B1 * | 11/2001 | McClain et al. | 8/158 |

(Continued)

FOREIGN PATENT DOCUMENTS

DE 10332656 7/2004

(Continued)

*Primary Examiner* — Stephen M. Gravini
(74) *Attorney, Agent, or Firm* — Pearne & Gordon LLP

(57) ABSTRACT

A home laundry drier (1) having a revolving drum (5) for housing the laundry to be dried, a hot-air generator (7) for circulating a stream of hot air inside the drum (5), and a steam generator (17) for feeding steam into the drum (5); the steam generator (17) having an electric boiler (18) designed to receive a given quantity of water and immediately convert it into a stream of low-pressure steam to be fed into the drum (5), a demineralized-water reservoir (20) located over and communicating with the electric boiler (18), and a lint filter (23) located upstream from the water reservoir (20); the water reservoir (20) receiving distilled water from the water canister (12) of the heat exchanger (10) of the hot-air generator (7) via a water drain circuit (13); and the laundry drier (1) also having a liquid level sensor (26) for determining when the water in the water reservoir (20) is below a given minimum level, and a central control unit (24) for determining whether the water reservoir (20) is in a given low-water-level condition at both the start and end of a user-selected drying cycle not including activation of the steam generator (17).

14 Claims, 1 Drawing Sheet

U.S. PATENT DOCUMENTS

| | | | | |
|---|---|---|---|---|
| 2010/0180465 | A1* | 7/2010 | Noviello et al. | 34/467 |
| 2010/0205820 | A1* | 8/2010 | Ashrafzadeh et al. | 34/389 |
| 2011/0239480 | A1* | 10/2011 | Choi et al. | 34/68 |
| 2011/0296628 | A1* | 12/2011 | Jenkins et al. | 8/137 |

FOREIGN PATENT DOCUMENTS

| | | | |
|---|---|---|---|
| EP | 1862584 | | 12/2007 |
| EP | 2014820 | A1 * | 1/2009 |

* cited by examiner

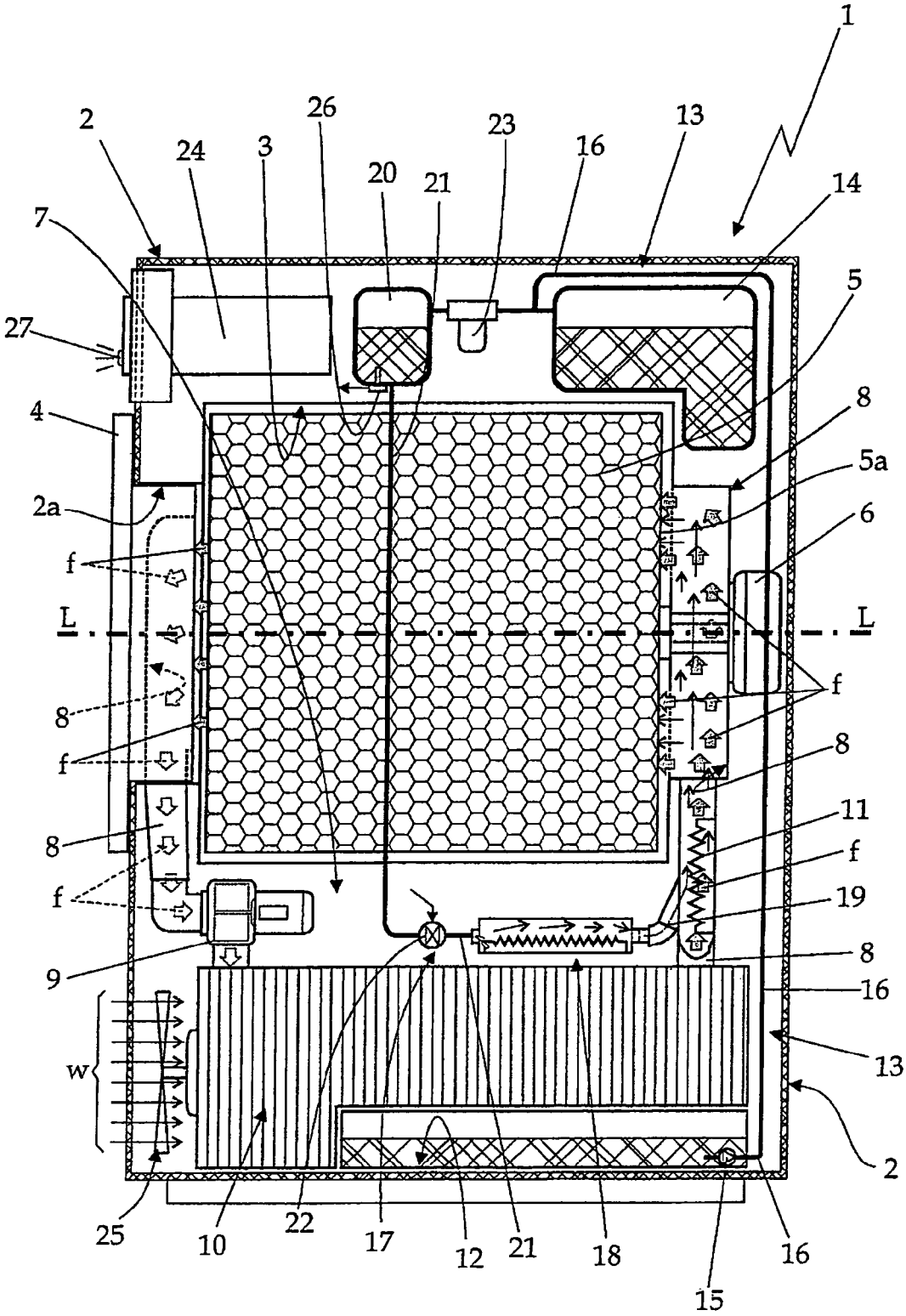
1
2
24
3
26
20
21
23
16
13
14
7
5
27
4
8
5a
2a
6
f
L
L
f
8
f
8
11
8
f
f
19
9
8
16
w
13
2
25
10
22
17
12
21
18
16
15

DETERMINING CLOG STEAM GENERATOR TANK FILTER LAUNDRY DRIER, AND APPARATUS

The present invention relates to a method of determining clogging of the steam generator tank filter of a home laundry drier, and to a home laundry drier implementing such a method.

More specifically, the present invention relates to a method of determining clogging of the steam generator tank filter of a rotary-drum home laundry drier, to which the following description refers purely by way of example.

As is known, rotary-drum laundry driers substantially comprise a substantially parallelepiped-shaped outer box casing; a cylindrical laundry drum housed in axially rotating manner inside the box casing, directly facing a laundry loading and unloading opening formed in the front face of the casing; a door hinged to the front face of the casing to rotate to and from a rest position closing the opening in the front face of the casing to seal the laundry drum; and an electric motor for rotating the laundry drum about its longitudinal axis inside the casing.

Rotary-drum laundry driers of the above type also comprise a closed-circuit, hot-air generator designed to circulate inside the laundry drum a stream of hot air with a low moisture content, and which flows through the laundry drum and over the laundry inside the drum to rapidly dry the laundry.

In the most widely marketed driers, the closed-circuit, hot-air generator comprises an air/air heat exchanger and an electric heater located one after the other along an air recirculating conduit, the two ends of which are connected to the laundry drum, on opposite sides of the latter. The air/air heat exchanger provides for rapidly cooling the airflow from the laundry drum to condense the surplus moisture in the airflow; and the heater provides for rapidly heating the airflow from the heat exchanger back to the laundry drum, so that the air flowing into the drum is heated rapidly to a temperature higher than or equal to that of the same air flowing out of the laundry drum.

Some more recently marketed rotary-drum driers also feature a pressurized-steam generator which, at the end of the drying cycle, feeds a jet of steam into the laundry drum to eliminate or at least greatly reduce wrinkling of the fabrics produced during the drying cycle.

Currently used steam generators have substantially the same structure as ordinary irons with a separate boiler, and comprise a demineralized-water reservoir housed in the highest part of the household appliance casing for easy manual refill with distilled/demineralized water; and an electric steam generating boiler normally located below the demineralized-water reservoir and connected to it by a connecting pipe. Water flows by gravity into the electric boiler under control of an electrovalve placed along the connecting pipe.

To avoid or greatly reduce manual refilling of the water reservoir, currently used steam generators are fed with demineralized water from the heat exchanger of the hot-air generator by a water drain circuit, which sucks up the distilled water stored up in the bottom of the heat exchanger by condensation, and feeds it to a high-capacity manually-removable waste-water tank placed inside the casing.

More specifically, the steam generator water reservoir is connected to the same electric pump which sucks up the distilled water from the heat exchanger and feeds it into the manually-removable waste-water tank, so as to receive part of the distilled water drawn from the bottom of the heat exchanger.

To keep fluff and/or lint particles out of the water reservoir, currently used steam generators are also fitted with a removable filter located between the connecting pipe from the electric pump of the water drain circuit and the inlet of the steam generator water reservoir. This filter must be manually removed and cleaned periodically to ensure efficient operation of the steam generator.

In currently marketed laundry driers, the user is expected to remove and clean the filter at given times, regardless of the extent to which the filter is actually clogged.

It is the object of the present invention to provide a home laundry drier designed to relieve the user from scheduled removal and cleaning of the steam generator tank filter.

According to the present invention, there is provided a method of determining clogging of the steam generator tank filter of a home laundry drier, as claimed in Claim 1 and preferably, though not necessarily, in any one of the dependent Claims.

According to the present invention, there is also provided a home laundry drier, as claimed in Claim 5 and preferably, though not necessarily, in any one of the dependent Claims.

The present invention will be described with reference to the attached drawing, which shows a side view, with parts in section and parts removed for clarity, of a home laundry drier in accordance with the teachings of the present invention.

Number 1 in the attached drawing indicates as a whole a home laundry drier substantially comprising a preferably, though not necessarily, parallelepiped-shaped outer box casing 2; an airtight, preferably, though not necessarily, cylindrical laundry drying tub or chamber 3 for housing the laundry to be dried, and which is fixed substantially horizontally inside casing 2, directly facing a laundry loading and unloading opening 2*a* formed in the front face of casing 2; a door 4 hinged to the front face of casing 2 to rotate to and from a rest position closing opening 2*a* in the front face to seal laundry drying tub 3; and a preferably, though not necessarily, cylindrical laundry drum 5 for housing the laundry to be dried, and which is housed in axially rotating manner and preferably, though not necessarily, horizontally inside drying tub 3.

More specifically, with reference to the attached drawing, laundry drum 5 has an end wall 5*a*, and possibly a cylindrical lateral wall, perforated, or at any rate permeable to air, to permit airflow into drum 5, and is mounted for rotation about its longitudinal axis L which, in the example shown, coincides with the longitudinal axis of drying tub 3.

Laundry drier 1 also comprises an electric motor 6 or similar, which, on command, rotates laundry drum 5 about longitudinal axis L inside drying tub 3; and a closed-circuit, hot-air generator 7 housed inside casing 2 and designed to circulate through laundry drum 5 a stream of hot air having a low moisture level, and which flows over and rapidly dries the laundry inside drum 5.

Casing 2, drying tub 3, door 4, laundry drum 5, and electric motor 6 are commonly known parts in the industry, and therefore not described in detail.

With reference to the attached drawing, closed-circuit, hot-air generator 7 provides for gradually drawing air from drying tub 3; extracting surplus moisture from the hot air drawn from drying tub 3; heating the dehumidified air to a predetermined temperature, normally higher than the temperature of the air from drying tub 3; and feeding the heated, dehumidified air back into drying tub 3, where it flows over, to rapidly dry, the laundry inside the tub.

In other words, hot-air generator 7 provides for continually dehumidifying and heating the air circulating inside drum 5 to rapidly dry the laundry inside the drum, and substantially comprises:

an air recirculating conduit 8, the two ends of which are connected to drying tub 3 preferably, though not necessarily, on opposite sides of laundry drum 5;

an electric centrifugal fan 9, or other type of air circulating pump, located along recirculating conduit 8 to produce, inside recirculating conduit 8, an airflow f, which flows into drying tub 3 and over the laundry inside drum 5;

an air/air heat exchanger 10 or similar—commonly referred to as a condenser—which is located along recirculating conduit 8 so that the airflow f from drying tub 3 and a cold airflow w from outside casing 2 flow through it simultaneously, and which is designed so that the cold airflow w rapidly cools the airflow f from drying tub 3 to condense the surplus moisture inside airflow f; and an electric heater 11 (in the example shown, a resistor) located along recirculating conduit 8, downstream from heat exchanger 10, and which provides for rapidly heating the airflow f from heat exchanger 10 back to drying tub 3, so that the air flowing into drying tub 3 is heated rapidly to a temperature preferably, though not necessarily, higher than or equal to that of the same air flowing out of drying tub 3.

More specifically, in the example shown, the intake end of recirculating conduit 8 is integrated in door 4, and the exhaust end of recirculating conduit 8 is connected directly to drying tub 3, in front of end wall 5*a* of laundry drum 5.

As regards heat exchanger 10, it is provided with a condensed-water canister 12 for collecting the liquid distilled water produced, when the drier is running, inside heat exchanger 10 by condensation of the surplus moisture in airflow f arriving from drying tub 3. More specifically, condensed-water canister 12 is located in the bottom of heat exchanger 10, and the capacity of condensed-water canister 12 is preferably, though not necessarily, insufficient to store all the distilled water produced during a drying cycle.

Given its large size, heat exchanger 10 is preferably located at the bottom of casing 2.

With reference to the attached drawing, hot-air generator 7 also has a water drain circuit 13 for draining the distilled water from water canister 12. Water drain circuit 13 comprises a high-capacity manually-removable waste-water tank 14 housed in easily removable manner inside casing 2, preferably, though not necessarily, near the top of the casing; and an electric pump 15, which, on command, sucks the distilled water from water canister 12 and feeds it to waste-water tank 14 over heat exchanger 10 via a connecting pipe 16.

More specifically, in the example shown, electric pump 15 is a submerged electric pump 15 located at the bottom of water canister 12 and it is switched on in known manner when the water level in water canister 12 exceeds a given upper threshold value.

Like some recently marketed laundry driers, drier 1 also comprises a pressurized-steam generator 17, which, on command, produces and feeds a jet of steam into laundry drum 5 to eliminate or at least greatly reduce wrinkling of the fabrics produced during the drying cycle.

With reference to the attached drawing, pressurized-steam generator 17 comprises an instant in-pressure electric boiler 18 designed to receive a given quantity of water and immediately convert it into a stream of low-pressure steam whose pressure is slightly higher than external pressure; a steam exhaust manifold 19 connecting the outlet of electric boiler 18 to recirculating conduit 8, preferably, though not necessarily, upstream from heater 11, to feed the low-pressure steam produced by electric boiler 18 directly to drying tub 3 and laundry drum 5 via the end portion of recirculating conduit 8; and a demineralized-water reservoir 20 which is housed inside casing 2, over electric boiler 18, and is connected to electric boiler 18 by a connecting pipe 21.

Water flows by gravity from water reservoir 20 to electric boiler 18, and pressurized-steam generator 17 has an electrovalve 22 along connecting pipe 21 to control outflow of water from water reservoir 20 to electric boiler 18.

More specifically, instant in-pressure electric boiler 18 is housed inside casing 2, directly over heat exchanger 10, and substantially consists of an airtight container housing a resistor dimensioned to immediately vaporize the water fed into the airtight container. Next to the connection to steam exhaust manifold 19, i.e. next to the outlet of electric boiler 18, the airtight container has a calibrated hole or opening sized to slow down steam spillage and increase the pressure of the steam inside the airtight container to above external pressure.

With reference to the attached drawing, to avoid or greatly reduce manual refilling with demineralized water, water reservoir 20 of pressurized-steam generator 17 communicates with water drain circuit 13 of hot-air generator 7, to receive part of the distilled water drained from water canister 12; and pressurized-steam generator 17 has a manually-removable filter 23 located upstream from water reservoir 20 and interposed between water drain circuit 13 and the inlet of water reservoir 20 to keep fluff and/or lint particles out of water reservoir 20.

More specifically, in the example shown, the end of connecting pipe 16 communicates with both filter 23 and waste-water tank 14; and filter 23 communicates with the inlet of water reservoir 20 so that, until completely full, water reservoir 20 receives approximately half the distilled water drained from water canister 12.

Electric boiler 18, steam exhaust manifold 19, water reservoir 20, electrovalve 22, and filter 23 are commonly known parts in the industry, and therefore not described in detail.

Like any other recently marketed electric household appliance, drier 1 also comprises an electronic central control unit 24, which controls electric motor 6, fan 9, heat exchanger 10 (or, rather, the cooling fan 25 of heat exchanger 10, which generates cold airflow w through the exchanger), and heater 11 in predetermined manner, as memorized inside it, to perform the user-selected drying cycle.

In addition to the above, control unit 24 also controls pressurized-steam generator 17 (i.e. electric boiler 18 and electrovalve 22) in predetermined manner, as memorized inside it, to feed a jet of low-pressure steam into laundry drum 5 when required by the user-selected drying cycle.

Unlike known home laundry driers, pressurized-steam generator 17 also has a liquid level sensor 26 for determining when water reservoir 20 is substantially empty of distilled/demineralized water, and control unit 24 acquires the status of water reservoir 20 from liquid level sensor 26 at both the start and end of the user-selected drying cycle, to immediately determine whether filter 23 is completely clogged.

More specifically, if the user-selected drying cycle does not include activation of pressurized-steam generator 17, control unit 24 acquires the status of water reservoir 20 from liquid level sensor 26 at both the start and end of the user-selected drying cycle, and determines whether water reservoir 20 is/was in the empty condition at both the start and end of the user-selected drying cycle. If water reservoir 20 is/was in the empty condition at both the start and end of the user-selected drying cycle, control unit 24 activates appropriate visual and/or acoustic warning means 27 to real-time alert the user to the urgent need to remove and clean filter 23.

More specifically, in the example shown, control unit 24 switches on a warning light 27 on the control panel of drier 1.

General operation of drier 1 is clearly inferable from the above description.

As regards operation of control unit 24, it is important to note that all drying cycles produce a lot of distilled water, which accumulates in water canister 12 and must be removed from water canister 12 at least once at the end of each drying cycle, on account of the small capacity of water canister 12. If the user-selected drying cycle does not include activation of pressurized-steam generator 17, at the end of the user-selected drying cycle, electric pump 15 pumps at least part of the distilled water in water canister 12 to water reservoir 20 of pressurized-steam generator 17, unless filter 23 is completely clogged or water reservoir 20 is completely full.

Accordingly, following user section of the desired drying cycle, control unit 24 determines whether the user-selected drying cycle includes activation of pressurized-steam generator 17.

If the user-selected drying cycle does not include activation of pressurized-steam generator 17, control unit 24 acquires the status of water reservoir 20 from liquid level sensor 26 at the start of the user-selected drying cycle, and then starts the drying cycle.

If water reservoir 20 is in the empty condition at the start of the user-selected drying cycle, control unit 24 acquires the status of water reservoir 20 again from liquid level sensor 26 at the end of the user-selected drying cycle, and determines whether water reservoir 20 is also in the empty condition at the end of the user-selected drying cycle.

If water reservoir 20 is in the empty condition at both the start and end of the user-selected drying cycle, control unit 24 determines complete clogging of filter 23, and activates visual and/or acoustic warning means 27 to real-time alert the user to the urgent need to remove and clean filter 23.

Obviously, in place of a water reservoir 20 in the empty condition, i.e. a water reservoir 20 containing no water, a water reservoir 20 containing a given minimum quantity of distilled/demineralized water, i.e. a given minimum water level in water reservoir 20, may be used as a reference condition.

In which case, liquid level sensor 26 determines when the water in water reservoir 20 is below said given minimum level, and control unit 24 determines whether the water level in water reservoir 20 remains below the given minimum level at both the start and end of the user-selected drying cycle.

If the user-selected drying cycle does not include activation of pressurized-steam generator 17, and water reservoir 20 remains in the low-level condition at both the start and end of the user-selected drying cycle, control unit 24 determines complete clogging of filter 23, and switches on a warning light 27.

Real-time detection of clogging of filter 23 has numerous advantages, foremost of which is that of relieving the user from periodic pointless removal and cleaning of filter 23, without complicating the household appliance structure.

Clearly, changes may be made to laundry drier 1 as described herein without, however, departing from the scope of the present invention.

For example, laundry drier 1 may not have laundry drying tub or chamber 3, and laundry drum 5 may be mounted to rotate axially directly inside casing 2. In which case, only end wall 5*a* of laundry drum 5 is perforated or permeable to air, and the exhaust end of recirculating conduit 8 is connected in airtight manner directly to end wall 5*a*. Moreover the front opening of laundry drum 5 directly faces laundry loading and unloading opening 2*a* in the front face of casing 2, and door 4 in the rest position airtight-seals the front opening of laundry drum 5 directly.

In a further embodiment, not shown, steam exhaust manifold 19 may bypass the end portion of recirculating conduit 8 and connect the outlet of electric boiler 18 directly to drying tub 3 or laundry drum 5.

In a still further embodiment, not shown, electrovalve 22 may be replaced by an electric pump which controls the outflow of water from water reservoir 20 to electric boiler 18, and also acts as one-way valve.

The invention claimed is:

1. Method of determining clogging of the lint filter (23) of the steam generator (17) of a home laundry drier (1), wherein said steam generator (17) comprises an electric boiler (18) designed to receive a given quantity of water and convert said water into low-pressure steam, a steam exhaust manifold (19) connecting the outlet of said electric boiler (18) to the laundry container (3, 5) of said home laundry drier (1), and a water reservoir (20) located above and communicating with said electric boiler (18); the home laundry drier (1) also comprising a hot-air generator (7) for circulating a stream of hot air inside the laundry container (3, 5), and a water drain circuit (13) which draws distilled water from the water canister (12) of the condenser (10) of said hot-air generator (7), and feeds said water at least partially into said water reservoir (20); the lint filter (23) of said steam generator (17) being interposed between said water drain circuit (13) and said water reservoir (20), and the method being characterized by comprising the steps of:

determining whether the water reservoir (20) is in a given low-water-level condition at the start of the user-selected drying cycle;

determining whether the water reservoir (20) is in said low-water-level condition at the end of the user-selected drying cycle; and determining clogging of the lint filter (23) of said steam generator (17) when the user-selected drying cycle does not include activation of said steam generator (17), and said water reservoir (20) remains in the low-water-level condition at both the start and end of the user-selected drying cycle.

2. Method of determining clogging of the lint filter of the steam generator, as claimed in claim 1, characterized in that the step of determining the status of said water reservoir (20) at the start of the user-selected drying cycle is only performed if said user-selected drying cycle does not include activation of said steam generator (17).

3. Method of determining clogging of the lint filter of the steam generator, as claimed in claim 1, characterized in that the step of determining the status of said water reservoir (20) at the end of the user-selected drying cycle is only performed if said water reservoir (20) is in the low-water-level condition at the start of the user-selected drying cycle.

4. Method of determining clogging of the lint filter of the steam generator, as claimed in claim 1, characterized in that said water reservoir (20) is in said low-water-level condition when it is almost empty of distilled/demineralized water.

5. Home laundry drier (1) comprising an outer box casing (2) and, inside the casing, a laundry container (3, 5) for housing the laundry to be dried, a hot-air generator (7) for circulating a stream of hot air inside the laundry container (3, 5), and a steam generator (17) for feeding steam into the laundry container (3, 5); said hot-air generator (7) comprising an air recirculating conduit (8) connected at both ends to said laundry container (3, 5), and a heat exchanger (10) located along said recirculating conduit (8) to cool the airflow (f) from the laundry container (3, 5) and condense the surplus moisture in said airflow (f); said heat exchanger (10) comprising a water canister (12) for collecting the liquid distilled water produced inside the heat exchanger (10) by condensation of the surplus moisture in the airflow (f) from the laundry container (3, 5); said steam generator (17) in turn comprising an electric boiler (18) designed to receive a given quantity of water and convert said water into a stream of low-pressure steam to be fed into the laundry container (3, 5), and a water reservoir (20) located over and communicating with said electric boiler (18); said hot-air generator (7) also comprising a water drain circuit (13) for drawing distilled water from said water canister (12) and feeding said water at least partially into said water reservoir (20); said steam generator (17) comprising a lint filter (23) interposed between said water drain circuit (13) and said water reservoir (20); said home laundry drier (1) being characterized by also comprising control means (24, 26) for determining when the water reservoir (20) of said steam generator (17) is in a given low-water-level condition; said control means (24, 26) also determining whether said water reservoir (20) remains in said given low-water-level condition at both the start and end of the user-selected drying cycle, when said user-selected drying cycle does not include activation of said steam generator (17).

6. Home laundry drier as claimed in claim 5, characterized by comprising visual and/or acoustic warning means (27); said control means (24, 26) activating said warning means (27) when said water reservoir (20) remains in said given low-water-level condition at both the start and end of a user-selected drying cycle not including activation of said steam generator (17).

7. Home laundry drier as claimed in claim 5, characterized in that said control means (24, 26) comprise a liquid level sensor (26) for determining when the water in the water reservoir (20) is below a given minimum level; the water reservoir (20) being in said low-water-level condition when the water level in the water reservoir (20) is below said given minimum level.

8. Home laundry drier as claimed in claim 7, characterized in that said liquid level sensor (26) determines when the water reservoir (20) is almost empty; the water reservoir (20) being in said low-water-level condition when it is almost empty.

9. Home laundry drier as claimed in claim 7, characterized in that said control means (24, 26) comprise a central control unit (24) connected to said liquid level sensor (26); said central control unit (24) determining when the user-selected drying cycle does not include activation of said steam generator (17), and whether said water reservoir (20) is in the low-water-level condition at both the start and end of the user-selected drying cycle.

10. Home laundry drier as claimed in claim 5, characterized in that said water drain circuit (13) comprises a high-capacity manually-removable waste-water tank (14) housed in easily removable manner inside the casing (2); and an electric pump (15), which, on command, sucks water from said water canister (12) and feeds it to both said waste-water tank (14) and the water reservoir (20) of said steam generator (17).

11. Home laundry drier as claimed in claim 5, characterized in that said steam generator (17) comprises a steam exhaust manifold (19) for channeling the steam from said electric boiler (18) into the laundry container (3, 5).

12. Home laundry drier as claimed in claim 11, characterized in that said steam exhaust manifold (19) connects the outlet of said electric boiler (18) to said recirculating conduit (8) to feed the steam produced in said electric boiler (18) into the laundry container (3, 5) via the end portion of said recirculating conduit (8).

13. Home laundry drier as claimed in claim 5, characterized in that said hot-air generator (7) also comprises first heating means (11) located along said recirculating conduit (8) to heat, on command, the airflow (f) flowing out from the heat exchanger (10) back into the laundry container (3, 5).

14. Home laundry drier as claimed in claim 5, characterized in that said laundry container (3, 5) comprises a rotary drum (5) for housing the laundry to be dried, and which is mounted for rotation about its longitudinal axis (L) inside said casing (2); the laundry drier also comprising a motor unit (6) for rotating said drum (5) about its longitudinal axis (L) on command.

* * * * *